United States Patent [19]

Krehm et al.

[11] Patent Number: 4,606,182

[45] Date of Patent: Aug. 19, 1986

[54] METHOD OF MAKING FUR BEARING STRANDS

[75] Inventors: Herman S. Krehm, 19 Rosemary Lane, Toronto, Ontario; Jacob Leidner, North York; Malcolm E. Rode, Brantford, all of Canada

[73] Assignee: Herman S. Krehm, Toronto, Canada

[21] Appl. No.: 646,746

[22] Filed: Sep. 4, 1984

[51] Int. Cl.[4] ..... A41H 41/00; C14B 15/10; D02G 3/06

[52] U.S. Cl. ..... 57/200; 57/259; 57/260; 57/31; 57/32; 8/94.14

[58] Field of Search ..... 57/200, 202, 203, 206, 57/210, 258, 259, 260, 4, 6, 7, 24, 28, 31, 32, 903; 8/94.14, 94.16, 94.27

[56] References Cited

U.S. PATENT DOCUMENTS

| | | | |
|---|---|---|---|
| 86,755 | 2/1869 | Hurn et al. . | |
| 1,119,120 | 12/1914 | Salzberger . | |
| 1,415,313 | 5/1922 | Cavanaugh . | |
| 1,713,113 | 10/1927 | Cavanaugh . | |
| 1,810,436 | 6/1931 | Rado . | |
| 2,067,895 | 1/1937 | Arbib . | |
| 2,127,228 | 3/1938 | McGimsey . | |
| 2,416,758 | 3/1947 | Knowles . | |
| 2,418,215 | 4/1947 | Lambert . | |
| 2,989,362 | 6/1961 | Heyden et al. | 8/94.14 |
| 3,147,582 | 9/1964 | Scharf . | |
| 3,413,798 | 12/1968 | Zur . | |
| 3,772,108 | 11/1973 | Lezhen et al. . | |
| 4,131,713 | 12/1978 | Barta et al. . | |
| 4,422,285 | 12/1983 | Rol | 57/31 |

FOREIGN PATENT DOCUMENTS

| | | |
|---|---|---|
| 1107487 | 8/1981 | Canada . |
| 23570 | 2/1883 | Fed. Rep. of Germany . |
| 355825 | 7/1922 | Fed. Rep. of Germany . |
| 95218 | 7/1968 | France . |
| 1561448 | 2/1969 | France . |
| 2177429 | 11/1971 | France . |
| 333290 | 10/1958 | Switzerland . |
| 1466058 | 12/1972 | United Kingdom . |

OTHER PUBLICATIONS

"The Evelyn Roth Recycling Book", published 1975, Evelyn Roth.

"North American Indian Arts", dated 1970 and 1973, by A. H. Whiteford

"Good Medicine", dated 1971, by Adolf Hungry Wolf, p. 15.

"The Material Culture of the Mistassini", by E. S. Rogers, dated 1967, pp. 40, 59, 64, 65.

"Indians of Canada", Sixth Edition dated 1963, p. 67.

*Primary Examiner*—Donald Watkins

*Attorney, Agent, or Firm*—Ridout & Maybee

[57] ABSTRACT

The invention provides a method for making fur bearing strands from hides of fur bearing animals and a yarn from such strands suitable for producing a fur garment. The yarn has low stretch characteristics by virtue of treatment of the hide portions used to make it. Strands are made from hide portions joined side by side at abutting longitudinal edges and slit transversely of the joined portion. A yarn is made from the strands, which may be joined end to end, by longitudinally twisting them so that the fur is substantially about the exterior thereof.

30 Claims, 6 Drawing Figures

METHOD OF MAKING FUR BEARING STRANDS

The invention relates to a method for making fur bearing strands from hides of fur bearing animals and a yarn from such strands suitable for producing a fur garment.

Prior methods for making a fur bearing yarn have proven unsatisfactory for several reasons. Animal hides from which strands are cut to make the yarn are inherently stretchable. This stretchability is transferred to the yarn and the fabric made therefrom. Clearly, this stretch characteristic is not desirable since garments made from such fabric will not hold their shape.

Previously, this problem of stretchability was addressed by mixing the yarn with a nonstretchable yarn in the production of the fabric, or the furred yarn itself was made by wrapping or twisting a furred strand of hide about a nonstretchable cord. A recent effort along these lines can be seen in Canadian Pat. No. 1,107,487 issued to Lishman on Aug. 25, 1981.

In addition to the stretch problem, it is difficult to make from a furred yarn a fabric or garment which has a natural appearance to it. A natural fur bearing hide has a clearly apparent grain to it, that is, the hairs of the fur run in roughly the same direction. There is also usually a gradient of hair length along the hide of a fur bearing animal with the hairs becoming longer from the neck toward the tail of the animal. Because of the manner in which prior furred yarns were made, the resulting fabric did not have a natural grain to the fur nor was there a gradient of hair length so as to give a natural appearance to the fabric.

BRIEF SUMMARY OF THE INVENTION

The present invention provides a yarn which has low stretch characteristics so that a fabric can be produced therefrom without the need to include other nonstretchable yarn or cord. The yarn is made by cutting strands from the hides in such a fashion to give a fabric or garment made therefrom a natural appearance. Thus, fabric made from the yarn of the present invention has a natural grain to the fur, and may, if desired, have a natural gradient to the lengths of hair comprising the fur.

Accordingly, the present invention provides a method of making fur bearing strands from hides of fur bearing animals, comprising joining side by side a plurality of hide portions with the fur in each portion running in the same direction parallel to the joining seams, and cutting strands transversely of said joined hides. A yarn may be made from the strands by twisting each strand longitudinally so that the fur is substantially about the exterior thereof.

The invention also provides that the stretchability of the hide may be reduced to an acceptable level by chrome tanning the hides or by treating them with a stretch reducing impregnant such as polyvinyl acetate latex.

BRIEF DESCRIPTION OF THE DRAWINGS

A preferred embodiment of the invention will hereinafter be described with reference being made to the drawings in which.

Figure 1:
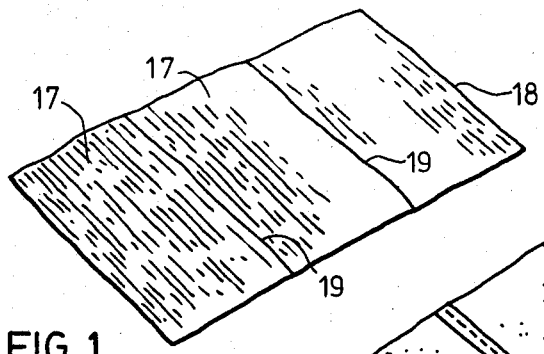
FIG. 1 is a perspective view from the furred side of hide portions joined together in accordance with the invention.
Figure 2:
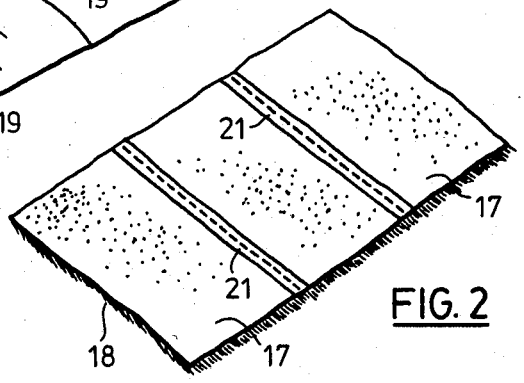
FIG. 2 is a perspective view from the back or furless side of hide portions showing one method of joining them together.
Figure 3:
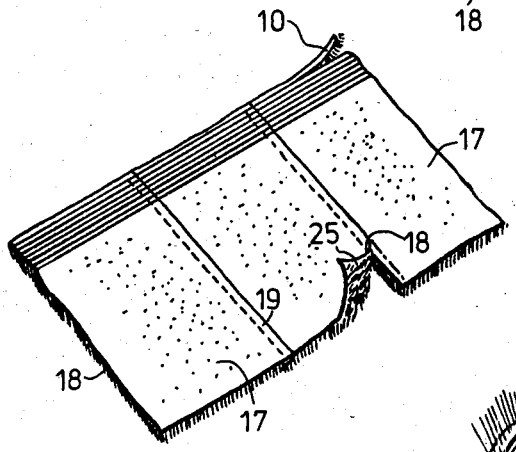
FIG. 3 is a perspective view as in FIG. 2 but showing a second method of joining the hide portions and also showing the slitting thereof to form strands.
Figure 4:
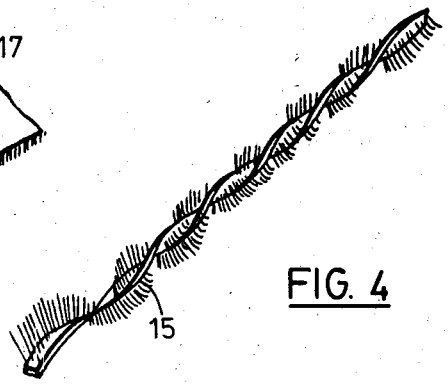
FIG. 4 shows the longitudinal twisting of a strand to form the yarn of the invention.
Figure 5:
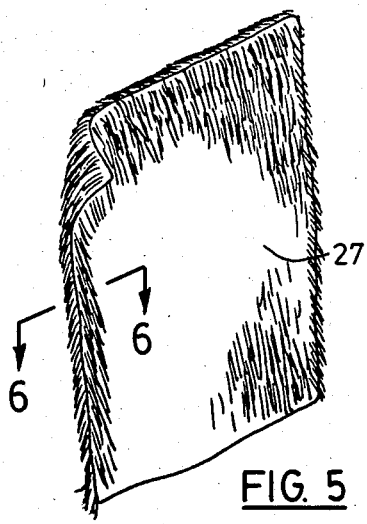
FIG. 5 is a perspective view of a piece of fabric woven using the yarn of FIG. 4.
Figure 6:
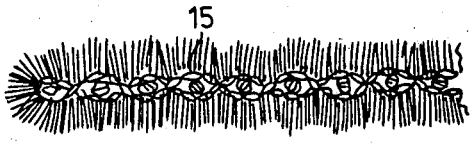
FIG. 6 is a sectional view along line 6—6 in FIG. 5.

Animal pelts generally thought to be suitable for production of the yarn of the present invention include those pelts of animals usually trapped or bred for the fur industry. Such pelts are normally tanned without the use of chromic acid or dichromate, thereby giving a softer more pliable hide than if a chrome tanning procedure is used. The hide from a normally tanned pelt may be used to make the yarn of the invention, however, the resulting yarn is generally felt to be too stretchable for most applications. A garment made from a stretchable yarn does not readily maintain its shape and is thus, generally undesirable.

It has been found that the stretchability of the hides used in the present invention can be reduced to an acceptable level by chrome tanning the untanned pelts, or chrome tanning hides previously tanned without chrome, or by impregnating the hides with a stretch reducing substance such as polyvinyl acetate latex. To achieve the lowest degree of stretchability it is often desirable to impregnate chrome tanned hides with polyvinyl acetate latex.

The production of strands 10 suitable for making a fur yarn 15 is carried out in accordance with the invention by initially selecting a plurality of pelts or hides from which are cut rectangular portions 17 each having approximately the same length and each having the grain of the fur thereon running in a compatible direction. Generally, the portions 17 are cut from each hide so as to produce the largest portion 17 possible. This usually means that the portions 17 are cut from the whole hides longitudinally so that the grain of the fur runs along the length of each portion 17.

The portions 17 are joined side by side along their longitudinal edges 18 at seams 19. Usually it is preferable to join the portion 17 so that the grain in each portion 17 is running in the same direction. The grain of the fur most commonly runs longitudinally parallel to the joining seams 19. The portions 17 may be joined by butting adjacent edges 18 of two portions 17 together and adhering a leather strip 21 thereover at the back or furless side of the hide portions 17. A second preferred joining method involves shaving or shearing a narrow strip 25 of fur along a longitudinal edge 18 of a first portion 17 and adhering the back of a second portion 17 at a longitudinal edge 18 thereof to the shaved strip 25.

The hide portions 17 may be treated to reduce stretchability, as explained above, either before or after they are joined together. As a practical matter chrome tanning can be economically and conveniently accomplished either before or after the portions 17 are joined together, but since impregnation of the hides with polyvinyl acetate latex or other stretch reducing substance is relatively more expensive than chrome tanning, it is preferred to carry out the impregnation process on the assembled hide portions 17.

To form the strands 10, the joined portions 17 are slit transversely. The slitting operation is preferably performed by a machine so that strands 10 of uniform width are obtained. The preferred width for the strands 10 used to make a yarn 15 is in the range 1.5 to 2.0 mm, with 1.75 mm being optimal in most cases.

Individual strands 10 cut from joined hide portions 17 may be joined together end to end to form a strand 10 of a desired length. The end to end joining of strands 10 may be most conveniently carried out by sewing or by adhering the back end of one strand 10 to a shaved front end of another strand 10.

The strand 10 thus produced can be made into a yarn 15 by simply twisting it about its longitudinal axis so that the furred side faces outwardly. This twisting is conveniently accomplished by a spinning wheel or the like. Prior to twisting the strand 10, it is preferable to stretch it longitudinally to remove residual pliancy therefrom. Loose hairs are also desirably removed from the strand 10 prior to twisting thereof by tumbling the strands 10 in a clothes drier or vacuuming the strands 10 by running them through a vacuum chamber. Often both steps of vacuuming and tumble drying are used.

The yarn 15 may be formed into a fabric 27 by knitting or weaving. A garment may be knitted directly from the yarn 15, and by virtue of the present method of making the yarn 15, such a garment will have a very natural appearance. Thus, when the hide portions 17 are assembled so that the grains of the fur in adjacent portions 17 all run in the same direction parallel to the joining seams 19, the knitted garment produced from the resulting yarn has a uniform grain to the fur on the exterior of the garment, which grain runs from the top to the bottom thereof. This uniformity of grain produces a very natural appearance to the garment in the manner of a fur garment made from a plurality of hides.

This natural effect can be further enhanced by taking advantage of the natural gradient in hair lengths on a fur bearing animal hide, the hairs being longer toward the tail of the animal. Hide portions 17 joined together having this natural hair length gradient will result in strands 10 cut from the tail end side of the joined portions 17 having longer hair than strands 10 cut toward the head end side thereof. By maintaining the hair length gradient of the strands 10 when joining them end to end to form a long strand 10, the resulting yarn will have fur at one end which is longer than that at the other end. By knitting a garment using the long fur end first, the garment will incorporate the natural fur length gradient as well as the natural fur grain thus further enhancing the attractiveness of the finished garment.

We claim:

1. A method of making fur bearing strands from hides of fur bearing animals, comprising:

joining side by side a plurality of hide portions with the fur grain in each portion running in the same direction, said hide portions being joined at seams by means of leather strips adhered longitudinally over the back of abutting edges of adjacent hide portions, said grain running parallel to the joining seams; and cutting strands transversely of said joined hide portions.

2. A method as claimed in claim 1, further comprising attaching a plurality of strands together end to end.

3. A method as claimed in claim 1, wherein the hide portions are chrome tanned.

4. A method as claimed in claim 1, wherein the hide backings are impregnated with polyvinyl acetate latex.

5. A method as claimed in claim 1, wherein the strands are cut in widths of from 1.5 to 2.0 mm.

6. A method as claimed in claim 5, wherein the strands are cut having widths of approximately 1.75 mm.

7. A method of making fur bearing yarn from hides of fur bearing animals, comprising:

joining side by side a plurality of hide portions at seams with the fur grain in each portion running in the same direction parallel to the joining seams, said hide portions being joined by means of leather strips adhered longitudinally over the back of abutting edges of adjacent hide portions;

cutting strands transversely of said joined hide portions; and twisting each strand longitudinally to form a yarn having the fur substantially about the exterior thereof.

8. A method as claimed in claim 7, further comprising attaching a plurality of strands together end to end prior to twisting thereof.

9. A method as claimed in claim 8, wherein the strands are attached to provide a yarn having a gradient of fur hair length from one end to the other.

10. A method as claimed in claim 9, further comprising rolling the yarn into a ball so that the end having the fur with the longest hair length is outermost.

11. A method as claimed in claim 7, wherein the hide portions are chrome tanned.

12. A method as claimed in claim 7, wherein the hide backings are impregnated with polyvinyl acetate latex.

13. A method as claimed in claim 7, wherein the strands are cut in widths of from 1.5 to 2.0 mm.

14. A method as claimed in claim 7, wherein the strands are cut having widths of approximately 1.75 mm.

15. A method of making fur bearing yarn from hides of fur bearing animals, comprising:

joining side by side a plurality of hide portions at seams with the fur grain in each portion running in the same direction parallel to the joining seams, said hide portions being joined by means of leather strips adhered longitudinally over the back of abutting edges of adjacent hide portions;

treating the back of the joined hide portions with a stretch reducing impregnant;

cutting strands transversely of the joined hide portions;

stretching the strands to further limit the stretchability thereof; and twisting each strand longitudinally to form a yarn having the fur substantially about the exterior thereof.

16. A method as claimed in claim 15, further comprising attaching a plurality of strands end to end prior to stretching and twisting thereof.

17. A method as claimed in claim 16, wherein the strands are attached to provide a yarn having a gradient of fur hair length from one end to the other.

18. A method as claimed in claim 17, further comprising rolling the yarn into a ball so that the end having the fur with the longest hair length is outermost.

19. A method as claimed in claim 15, wherein the hide portions are chrome tanned.

20. A method as claimed in claim 15, wherein the impregnant is polyvinyl acetate latex.

21. A method as claimed in claim 15, wherein the strands are cut in widths of from 1.5 to 2.0 mm.

22. A method as claimed in claim 15, wherein the strands are cut having widths of approximately 1.75 mm.

23. A method of making fur bearing yarn from hides of fur bearing animals, comprising:

joining side by side a plurality of hide portions at seams with the fur grain in each portion running in the same direction parallel to the joining seams;

cutting strands transversely of said joined hide portions;

attaching a plurality of strands together end to end to provide a gradient of fur hair length from one end to the other of the joined strands; and twisting the joined strands longitudinally to form a yarn having the fur substantially about the exterior thereof.

24. A method as claimed in claim 23, further comprising chrome tanning the hide portions prior to cutting strands from the joined hide portions.

25. A method as claimed in claim 23, further comprising impregnating the hide backings with polyvinyl acetate latex prior to cutting strands from the joined hide portions.

26. A method of making fur bearing yarn from hides of fur bearing animals, comprising:

joining side by side a plurality of hide portions at seams with the fur grain in each portion running in the same direction parallel to the joining seams;

treating the back of the joined hide portions with a stretch reducing impregnant;

cutting strands transversely of the joined hide portions;

stretching the strands to further limit the stretchability thereof;

attaching a plurality of strands together end to end to provide a gradient of fur hair length from one end to the other of the joined strands; and twisting each strand longitudinally to form a yarn having the fur substantially about the exterior thereof.

27. A method as claimed in claim 26, further comprising chrome tanning the hide portions prior to treating with a stretch reducing impregnant.

28. A method as claimed in claim 26, wherein the impregnant is polyvinyl acetate latex.

29. A method as claimed in claim 23 or 26, wherein the hide portions are joined by means of leather strips adhered longitudinally over the back of abutting edges of adjacent hide portions.

30. A method as claimed in claim 23 or 26, wherein the hide portions are joined by shaving a narrow strip of fur from a longitudinal edge of a first hide portion and adhering the first portion to a second hide portion by joining said shaved strip to the back of the second portion at a longitudinal edge thereof.

* * * * *